US008797215B2

(12) United States Patent
Su et al.

(10) Patent No.: US 8,797,215 B2
(45) Date of Patent: Aug. 5, 2014

(54) WIRE ANTENNA

(75) Inventors: Saou-Wen Su, Keelung (TW); Jui-Hung Chou, Tai-Chung (TW)

(73) Assignees: Lite-On Electronics (Guangzhou) Limited, Guangzhou (CN); Lite-On Technology Corporation, Taipei (TW)

( * ) Notice: Subject to any disclaimer, the term of this patent is extended or adjusted under 35 U.S.C. 154(b) by 749 days.

(21) Appl. No.: 12/357,402

(22) Filed: Jan. 22, 2009

(65) Prior Publication Data

US 2009/0295669 A1 Dec. 3, 2009

(30) Foreign Application Priority Data

May 27, 2008 (CN) ..... 2008 1 0028452

(51) Int. Cl.
*H01Q 1/24* (2006.01)
*H01Q 5/01* (2006.01)

(52) U.S. Cl.
USPC ..... 343/702; 343/828; 343/830

(58) Field of Classification Search
USPC ..... 343/700 MS, 702, 846, 848, 828–830
See application file for complete search history.

(56) References Cited

U.S. PATENT DOCUMENTS

| | | | | |
|---|---|---|---|---|
| 2,124,424 | A * | 7/1938 | McConnell | 343/825 |
| 4,259,673 | A * | 3/1981 | Guretzky | 343/825 |
| 4,644,364 | A * | 2/1987 | Parks | 343/825 |
| 5,451,971 | A * | 9/1995 | Grossman et al. | 343/828 |
| 6,184,833 | B1 * | 2/2001 | Tran | 343/700 MS |
| 6,677,905 | B2 * | 1/2004 | Deguchi et al. | 343/702 |
| 7,365,689 | B2 * | 4/2008 | Lee | 343/700 MS |
| 2007/0296636 | A1 | 12/2007 | Lee | |

* cited by examiner

*Primary Examiner* — Michael C Wimer
(74) *Attorney, Agent, or Firm* — Li & Cai Intellectual Property (USA) Office

(57) ABSTRACT

A wire antenna comprises a main radiating element, a grounding element, a shorting element, and a coaxial cable. The said main radiating element and the said grounding element are linked by the said shorting element. A central conducting wire and an outer grounding conductor of the coaxial cable are electrically connected to the first and the second points on the said main radiating element and the said grounding element respectively. The main radiating element and the grounding element are all made of a single metal wire with compact size and low cost. The present invention is capable of single or dual-band operation for applications in WLAN devices.

6 Claims, 11 Drawing Sheets

WIRE ANTENNA

BACKGROUND OF THE INVENTION

1. Field of the Invention

The present invention relates to a wire antenna, and more particularly to a small wire antenna applied to wireless communication devices.

2. Description of the Prior Art

With the improvement of wireless network technology, a user can use wireless network anytime and anywhere. The antenna structure in wireless network technology is often designed that an antenna and a grounding element are integrated as a same element. An inverted F type antenna has been extensively applied in particular.

Please refer to FIG. 1. FIG. 1 is a schematic diagram of an inverted F type antenna in the prior art. U.S. patent publication no. 20070296636A1 discloses a planar antenna, which is the inverted F type antenna structure operating in the 2.4 GHz band.

In FIG. 1, a main radiating element A is smaller than a grounding element B. Owing to a grounding plane made of a metal, it increases size and cost of an antenna. However, wireless network terminal devices tend towards miniaturization and portable designs by user request, and internal antenna designs also tend towards miniaturization accordingly.

The inverted F type antenna is only capable of operating in a single band in present wireless network technology. Therefore, the conventional inverted F type antenna can not achieve requested dual-band operation. However the mainstream of electronic products tends towards dual-band operation in wireless network technology.

SUMMARY OF THE INVENTION

According to the claimed invention, a wire antenna is composed of a multiple-bent single metal wire for single-band operation in a wireless network device. The wire antenna includes a main radiating element having a first feed end and a first feed point adjacent to a first feed end, and a grounding element parallel to the main radiating element. The grounding element includes a second feed end and a second feed point adjacent to a second feed end. The wire antenna further includes a shorting element electrically connected to the first feed end and the second feed end on both ends.

According to the claimed invention, a wire antenna is composed of a multiple-bent single metal wire for dual-band operation in a wireless network device. The wire antenna includes a main radiating element having a first feed end and a first feed point adjacent to a first feed end, and a grounding element including a first element parallel to the main radiating element. The first element includes a second feed end and a first end, and a second feed point is adjacent to the second feed end. The grounding element further includes a second element parallel to the first element. The second element includes a second end. The grounding element further includes a third element connected to the first and the second ends on both ends. The wire antenna further includes a shorting element electrically connected to the first feed end and the second feed end on both ends.

These and other objectives of the present invention will no doubt become obvious to those of ordinary skill in the art after reading the following detailed description of the preferred embodiment that is illustrated in the various figures and drawings.

DETAILED DESCRIPTION

A wire antenna of the present invention is applied to wireless network devices, such as Bluetooth or Wi-Fi cell phones, PDAs, wireless digital photo frames, and notebook computers. Additionally, the wire antenna is required to conform to IEEE 802.11a, 802.11b, and 802.11g standards, and can be a dual-band antenna operating in the 2.4 GHz and 5.2 GHz bands.

Figure 1:
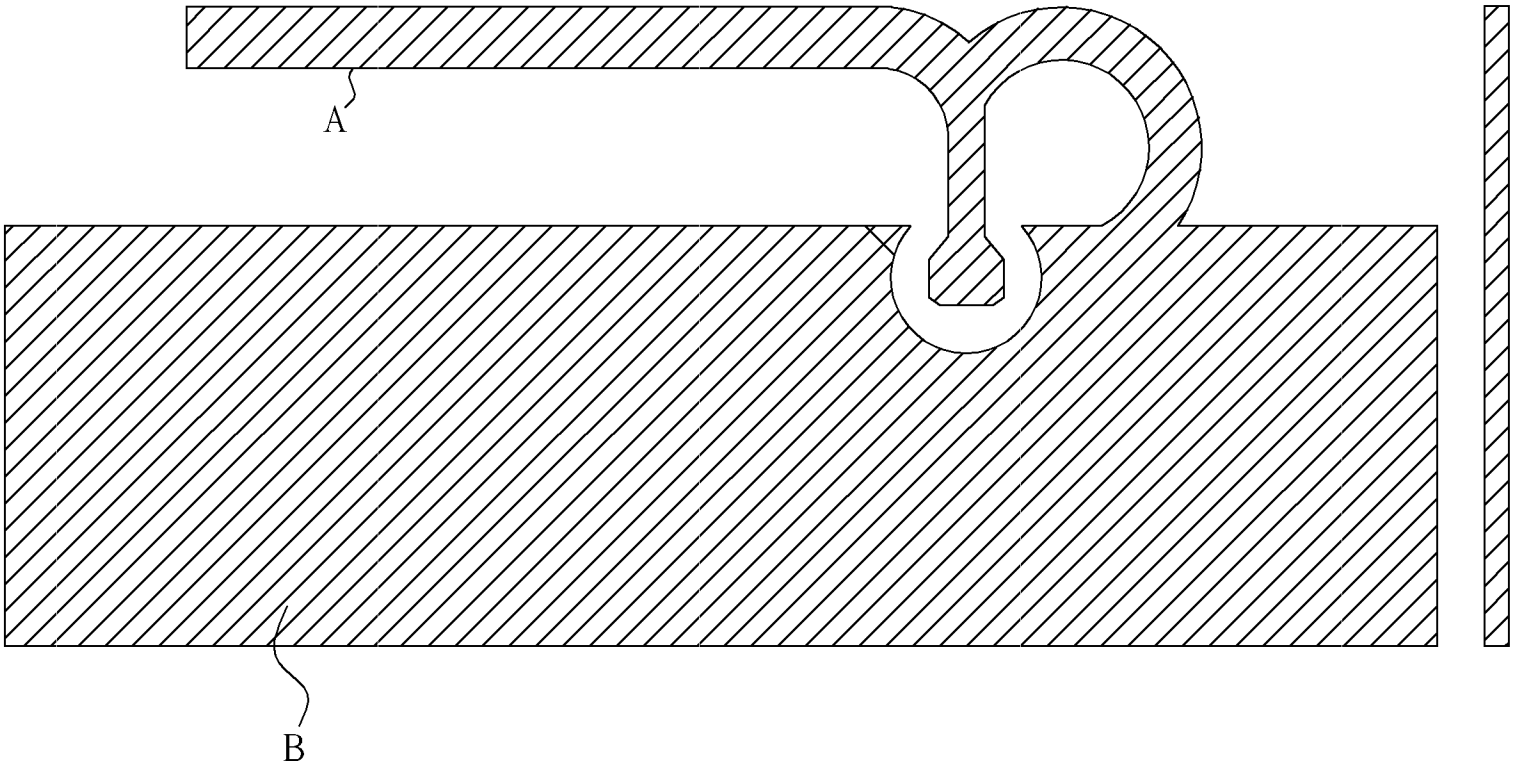
FIG. 1 PRIOR ART
FIG. 1 is a schematic diagram of an inverted F type antenna in the prior art.
Figure 2:
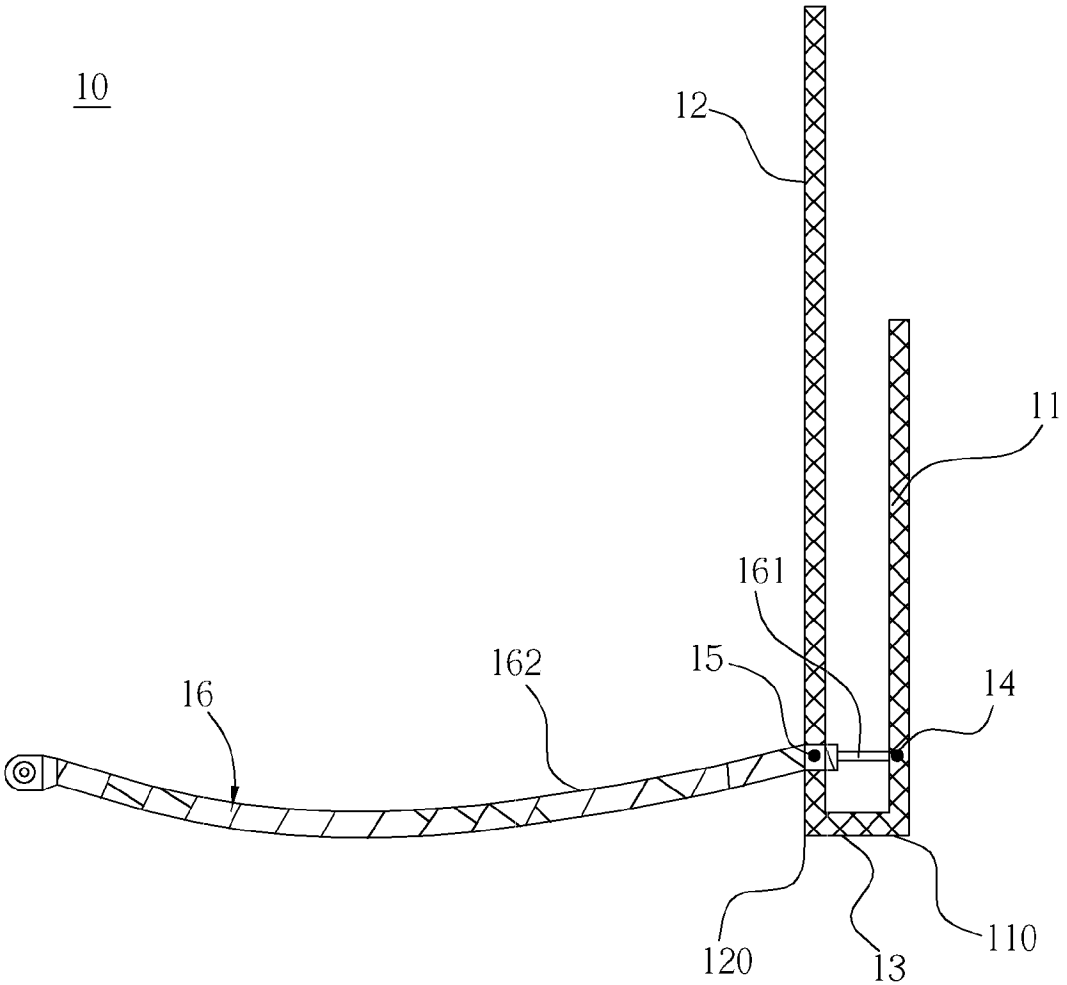
FIG. 2 is a schematic diagram of a wire antenna according to a first embodiment of the present invention.

Please refer to FIG. 2. FIG. 2 is a schematic diagram of a wire antenna 10 according to a first embodiment of the present invention. The wire antenna 10 includes a main radiating element 11, a grounding element 12, and a shorting element 13. The main radiating element 11 includes a first feed end 110 and a first feed point 14 adjacent to the first feed end 110. The grounding element 12 includes a second feed end 120 and a second feed point 15 adjacent to the second feed end 120. The shorting element 13 is electrically connected to the first feed end 110 and the second feed end 120 on both ends.

The wire antenna 10 further includes a coaxial cable 16 including a central conducting wire 161 and an outer grounding conductor 162. Additionally, the first feed point 14 is electrically connected to a signal source by connecting the central conducting wire 161 of the coaxial cable 16. The second feed point 15 is electrically connected to the outer grounding conductor 162 and is electrically connected to a grounding end of a wireless network device via the outer grounding conductor 162.

The wire antenna 10 can be made of copper, enameled wire or single core wire. Additionally, a characteristic impedance of the coaxial cable 16 is 50Ω substantially for transmitting signals.

In the first embodiment, the size of the main radiating element 11, the grounding element 12, and the shorting element 13 can be 25 mm, 40 mm, and 5 mm respectively. A distance between the first feed point 14 and the first feed end 110, and a distance between the second feed point 15 and the second feed end 120 are 3 mm respectively. In addition, the size and the distance of the above-mentioned elements are not limited to the above-mentioned values. The length of the main radiating element 11 is less than the length of the grounding element 12. The distance between the first feed point 14, the second feed point 15, and the shorting element 13 can be fine-tuned slightly to obtain well antenna impedance matching over the 2.4 GHz wireless local area network (WLAN) band.

Figure 5:
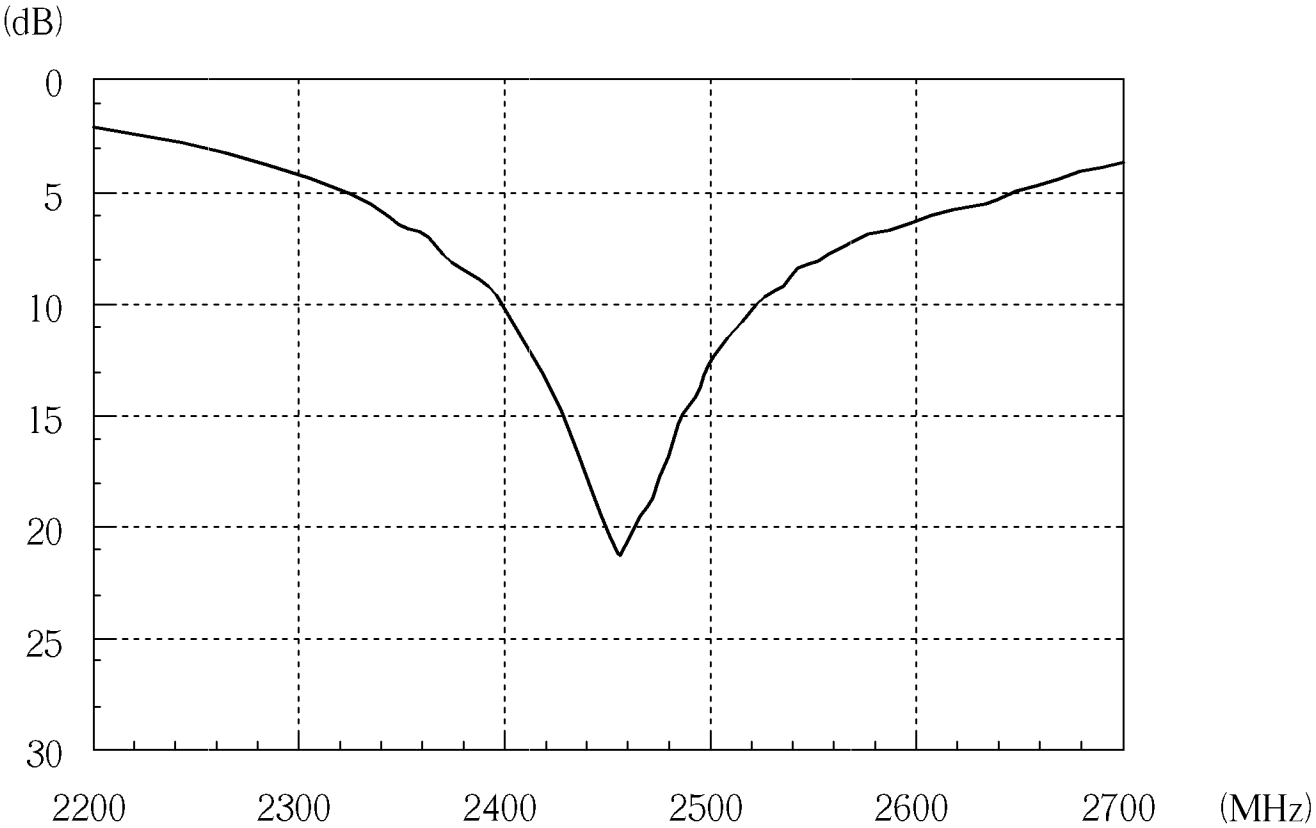
FIG. 5 is a measured schematic diagram of return loss according to the first embodiment of the present invention.

Please refer to FIG. 5. FIG. 5 is a measured schematic diagram of return loss according to the first embodiment of the present invention. The result of the operating frequency of the wire antenna 10 is about 2398-2523 MHz, and the bandwidth is about 150 MHz covering the 2.4 GHz WLAN band, defined by 10 dB return loss, according to the first embodiment.

Figure 6:
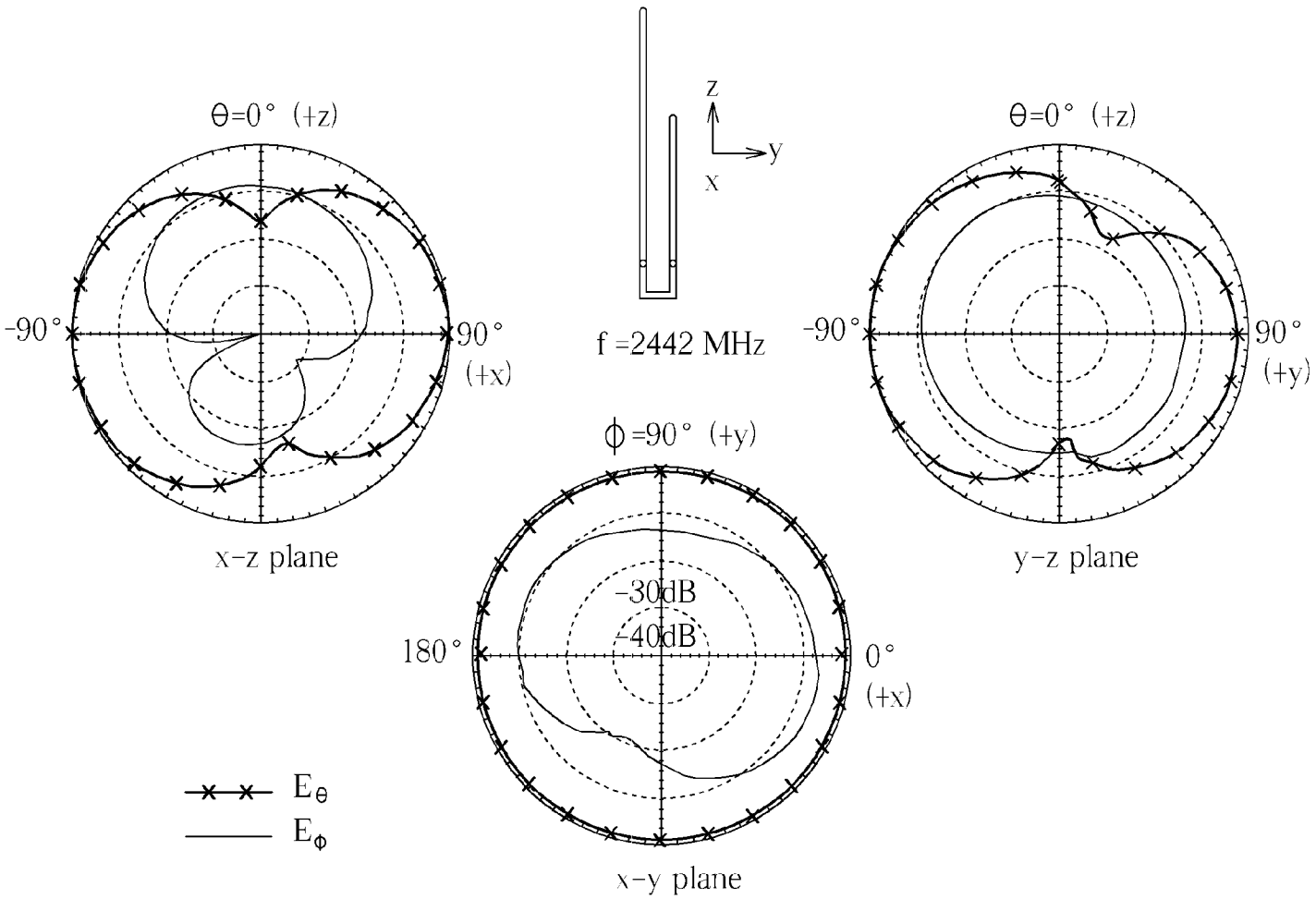
FIG. 6 is a measured schematic diagram of the radiation patterns at 2.4 GHz according to the first embodiment of the present invention.

Please refer to FIG. 6. FIG. 6 is a measured schematic diagram of the radiation patterns at 2.4 GHz according to the first embodiment of the present invention. FIG. 6 shows the result of the radiation pattern operating at 2442 MHz. The radiation pattern of the horizontal plane (x-y plane) is an omnidirectional radiation pattern, which meets application requirement of WLAN operation.

Figure 7:
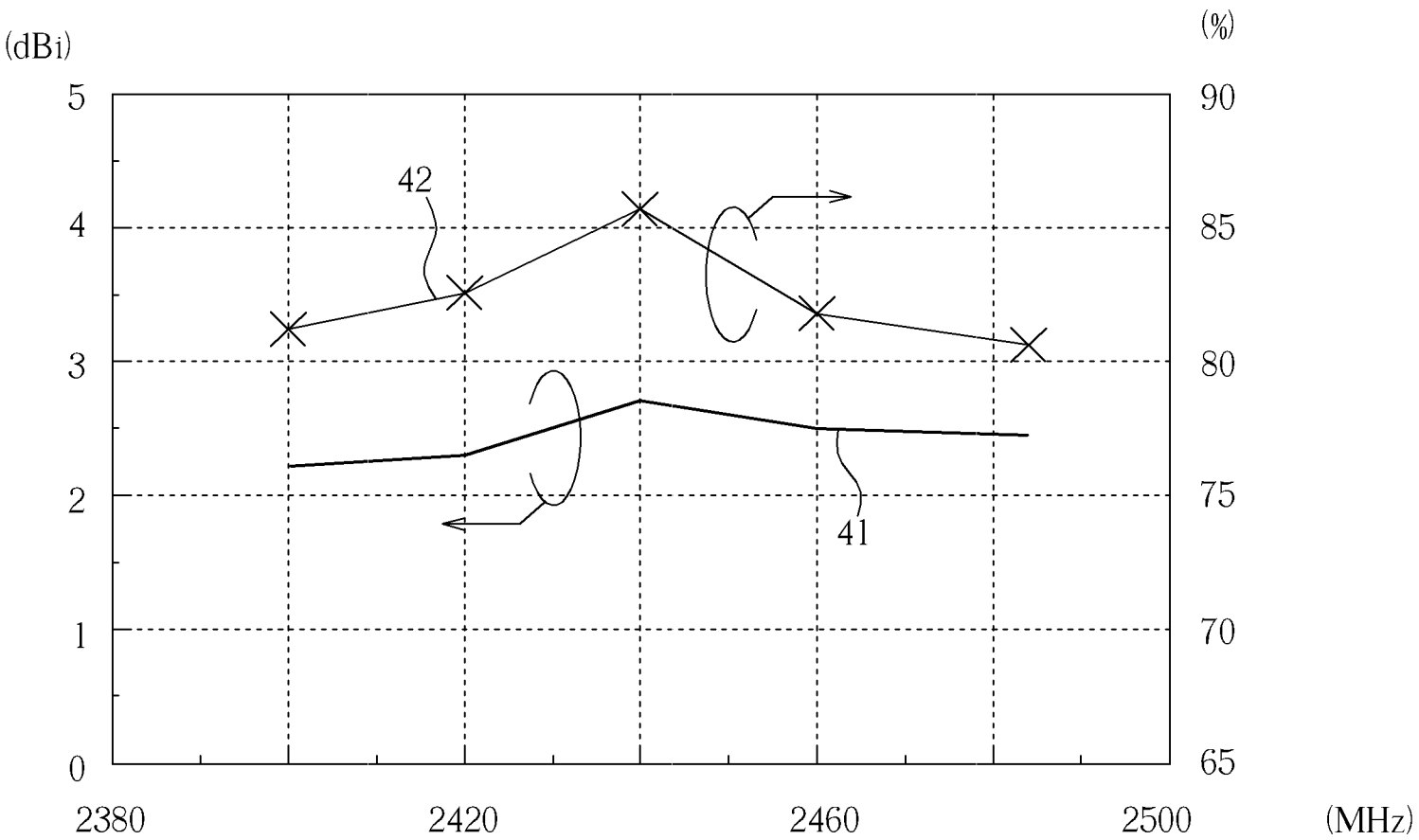
FIG. 7 is a measured schematic diagram of antenna gain and radiation efficiency according to the first embodiment of the present invention.

Please refer to FIG. 7. FIG. 7 is a measured schematic diagram of antenna gain and radiation efficiency according to the first embodiment of the present invention. FIG. 7 shows that antenna gain 41 is between 2~3 dBi over the 2.4 GHz band, and radiation efficiency 42 is above 80%. Therefore, it has good radiation characteristics of the 2.4 GHz band operation according to the first embodiment.

Figure 3:
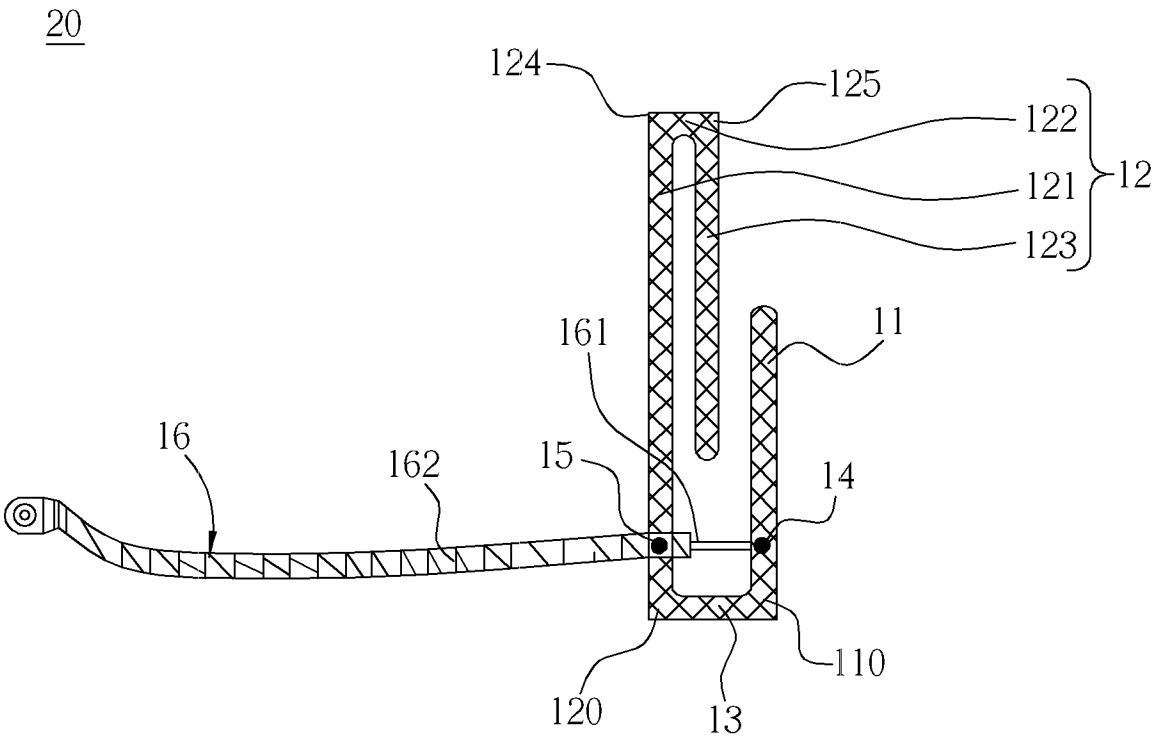
FIG. 3 is a schematic diagram of a wire antenna according to a second embodiment A of the present invention.

Please refer to FIG. 3. FIG. 3 is a schematic diagram of a wire antenna 20 according to a second embodiment A of the present invention. The wire antenna 20 includes the main radiating element 11, the grounding element 12, and the shorting element 13. Comparing with the first embodiment, the main radiating element 11 of the second embodiment A is smaller than the main radiating element 11 of the first embodiment. Besides, the grounding element 12 is bent repeatedly such as being bent twice and displays an ∩ structure and the like. The grounding element 12 includes a first element 121, a second element 123, and a third element 122 so that the wire antenna 20 is a paper clip structure.

The main radiating element 11 includes the first feed end 110 and a first feed point 14 adjacent to the first feed end 110. The first element 121 of the grounding element 12 includes the second feed end 120 and a first end 124, and a second feed point 15 is adjacent to the second feed end 120. The shorting element 13 is electrically connected to the first feed end 110 and the second feed end 120 on both ends. The third element 122 is connected to the first end 124 and a second end 125 of the second element 123 on both ends.

The wire antenna 20 according to the second embodiment A further includes the coaxial cable 16 which includes the central conducting wire 161 and the outer grounding conductor 162. The first feed point 14 is electrically connected to a signal source via connection with the central conducting wire 161 of the coaxial cable 16. The second feed point 15 is electrically connected to a grounding end of a wireless network device via the outer grounding conductor 162.

Figure 4:
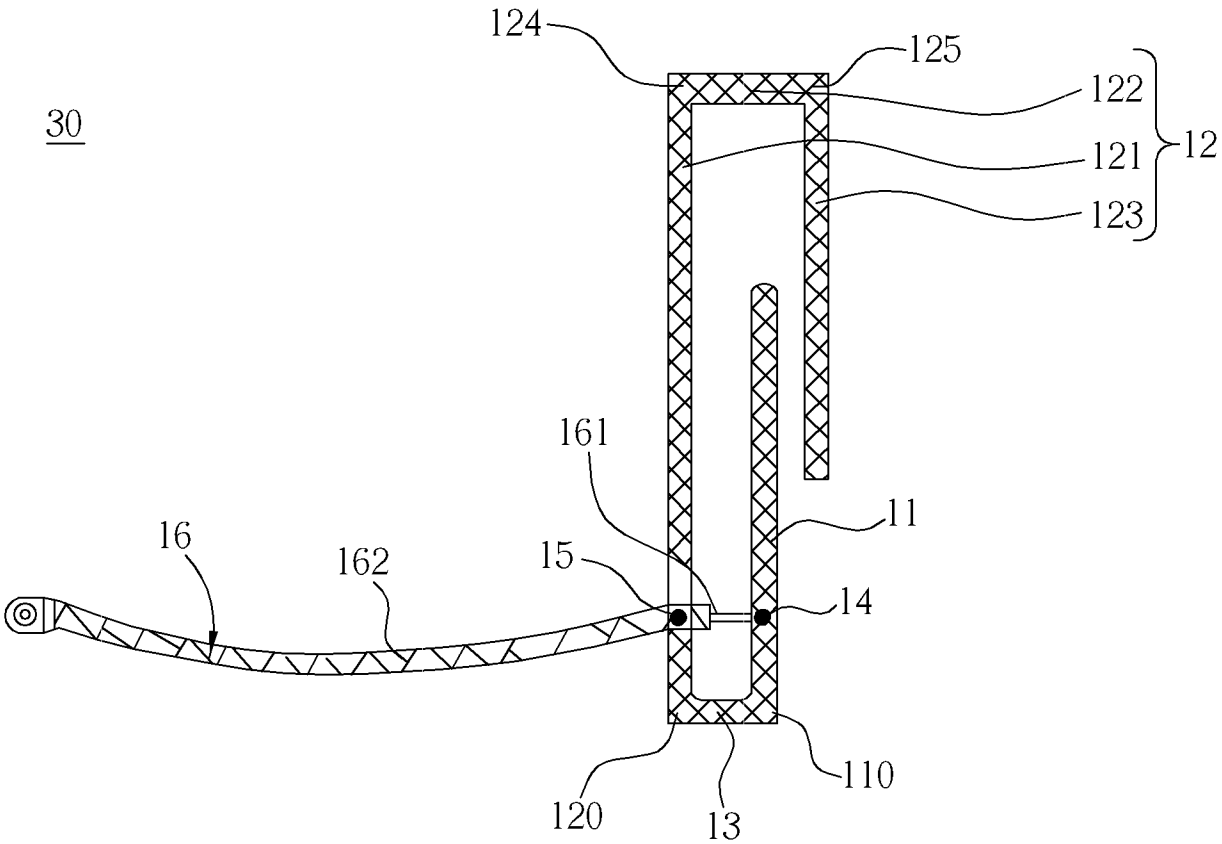
FIG. 4 is a schematic diagram of the wire antenna according to a second embodiment B of the present invention.

Please refer to FIG. 4. FIG. 4 is a schematic diagram of the wire antenna 30 according to a second embodiment B of the present invention. The wire antenna 30 includes the main radiating element 11, the grounding element 12 and the shorting element 13. Comparing with the first embodiment, the main radiating element 11 of the second embodiment B is smaller than the main radiating element 11 of the first embodiment. Besides, the grounding element 12 is bent repeatedly such as being bent twice and displays an ∩ structure and the like. The grounding element 12 includes a first element 121, a second element 123, and a third element 122 so that the wire antenna 30 is a paper clip structure. Additionally, the main radiating element 11 is disposed between the first element 121 and the second element 123.

The main radiating element 11 includes the first feed end 110 and a first feed point 14 adjacent to the first feed end 110. The first element 121 of the grounding element 12 includes a second feed end 120 and a first end 124, and a second feed point 15 is adjacent to the second feed end 120. The shorting element 13 is electrically connected to the first feed end 110 and the second feed end 120 on both ends. The third element 122 is connected to the first end 124 and the second end 125 of the second element 123 on both ends.

The wire antenna 30 according to the second embodiment B further includes the coaxial cable 16 which includes the central conducting wire 161 and the outer grounding conductor 162. The first feed point 14 is electrically connected a signal source via connection with the central conducting wire 161 of the coaxial cable 16. The second feed point 15 is electrically connected to a grounding end of a wireless network device via the outer grounding conductor 162.

Comparing with the second element 123 located between the main radiating element 11 and the first element 121 as shown in FIG. 3, the main radiating element 11 shown in FIG. 4 is disposed between the first element 121 and second element 123.

Please refer to FIG. 3 again. The size of the main radiating element 11, the first element 121, the second element 123, the third element 122, and the shorting element 13 can be 14.5 mm, 23.5 mm, 18.5 mm, 2.5 mm, and 5 mm respectively according to the second embodiment A. A distance between the first feed point 14 and the first feed end 110, and a distance between the second feed point 15 and the second feed end 120 are 2 mm respectively. The main radiating element 11 is smaller than the grounding element 12 according to the second embodiment A. The distance between the first feed point 14, the second feed point 15, and the shorting element 13 can be fine-tuned slightly to obtain well antenna impedance matching over the 2.4/5.2 GHz wireless local area network bands. In addition, the size and the distance of the above-mentioned element are not limited to the above-mentioned values.

Comparing with the first embodiment, the main radiating element 11 can be excited at 5250 MHz (upper resonant mode). A length of the bending grounding element 12 is about quarter wavelength at 2442 MHz, and the bending grounding element 12 can be excited at 2442 MHz (lower resonant mode). So it can obtain well impedance bandwidth in two resonant modes for achieving 2.4/5.2 GHz double-band WLAN operation by fine-tuning coupling characteristic of the grounding element 12 and the main radiating element 11.

Figure 8:
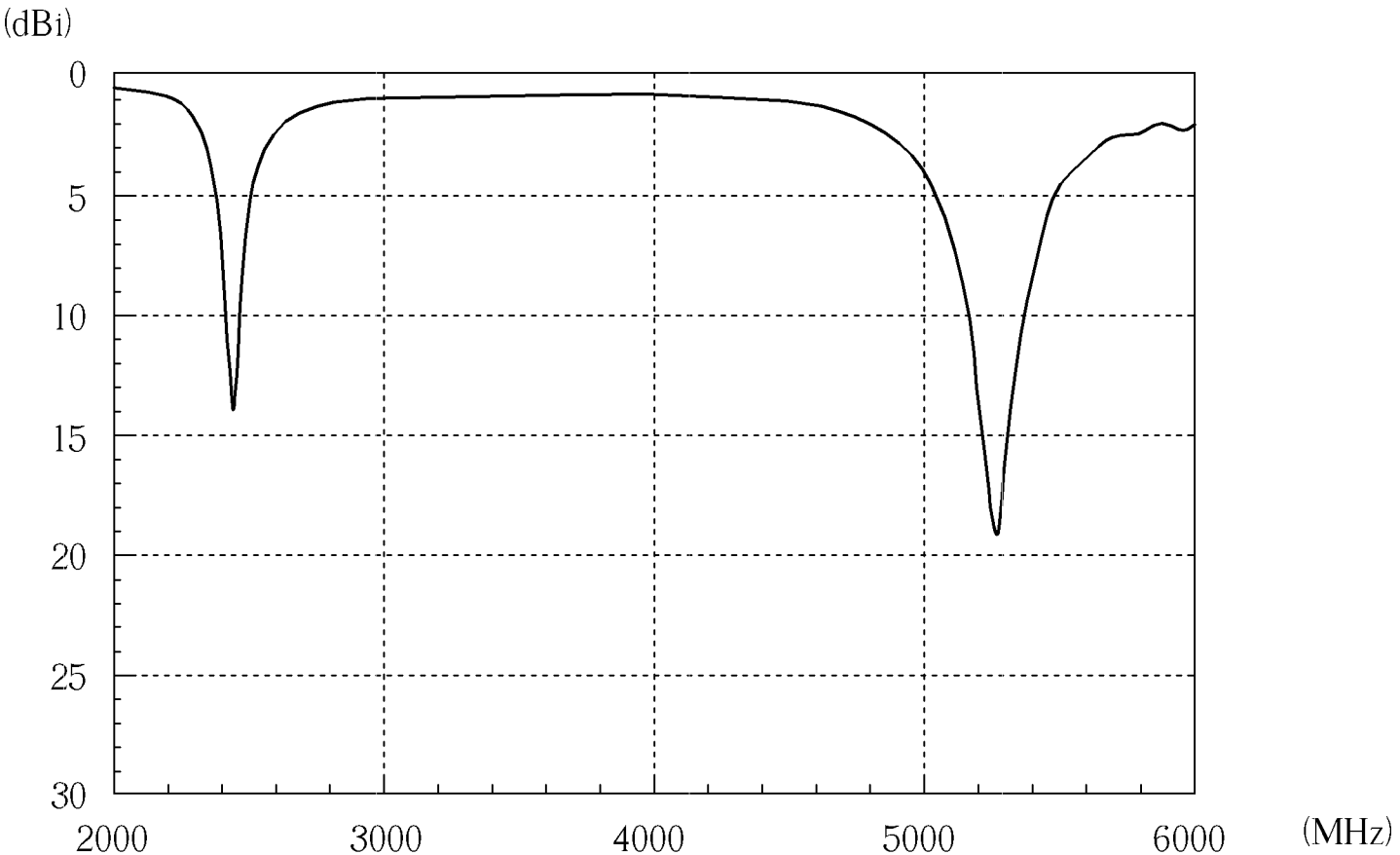
FIG. 8 is a measured schematic diagram of return loss according to the second embodiment according of the present invention.

Please refer to FIG. 8. FIG. 8 is a measured schematic diagram of return loss according to the second embodiment according of the present invention. FIG. 8 shows that the return loss of the impedance bandwidth over the 2.4 GHz and 5.2 GHz bands is smaller than 7.3 dB.

Figure 9:
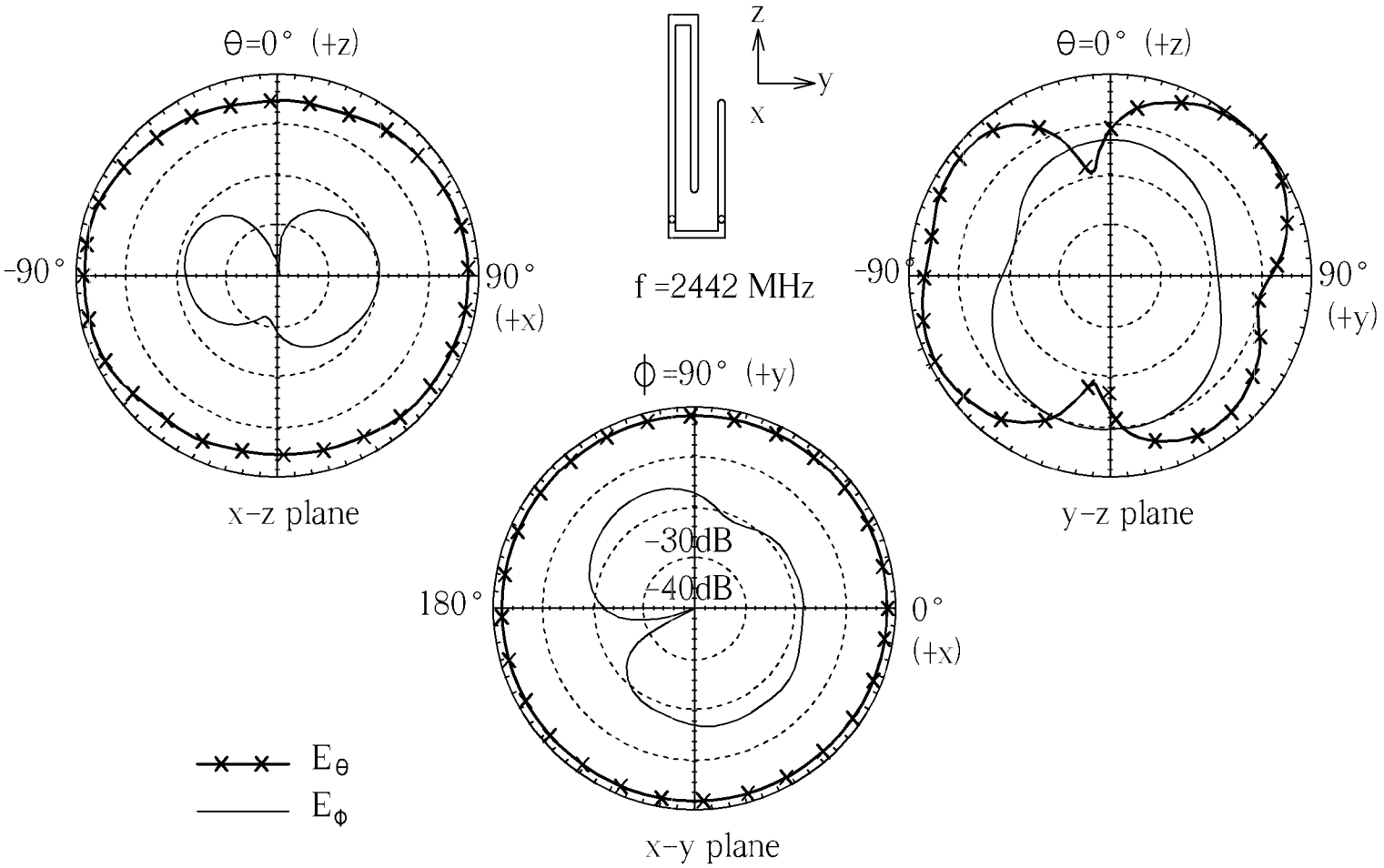
FIG. 9 is a measured schematic diagram of radiation patterns at 2.4 GHz according to the second embodiment of the present invention.
Figure 10:
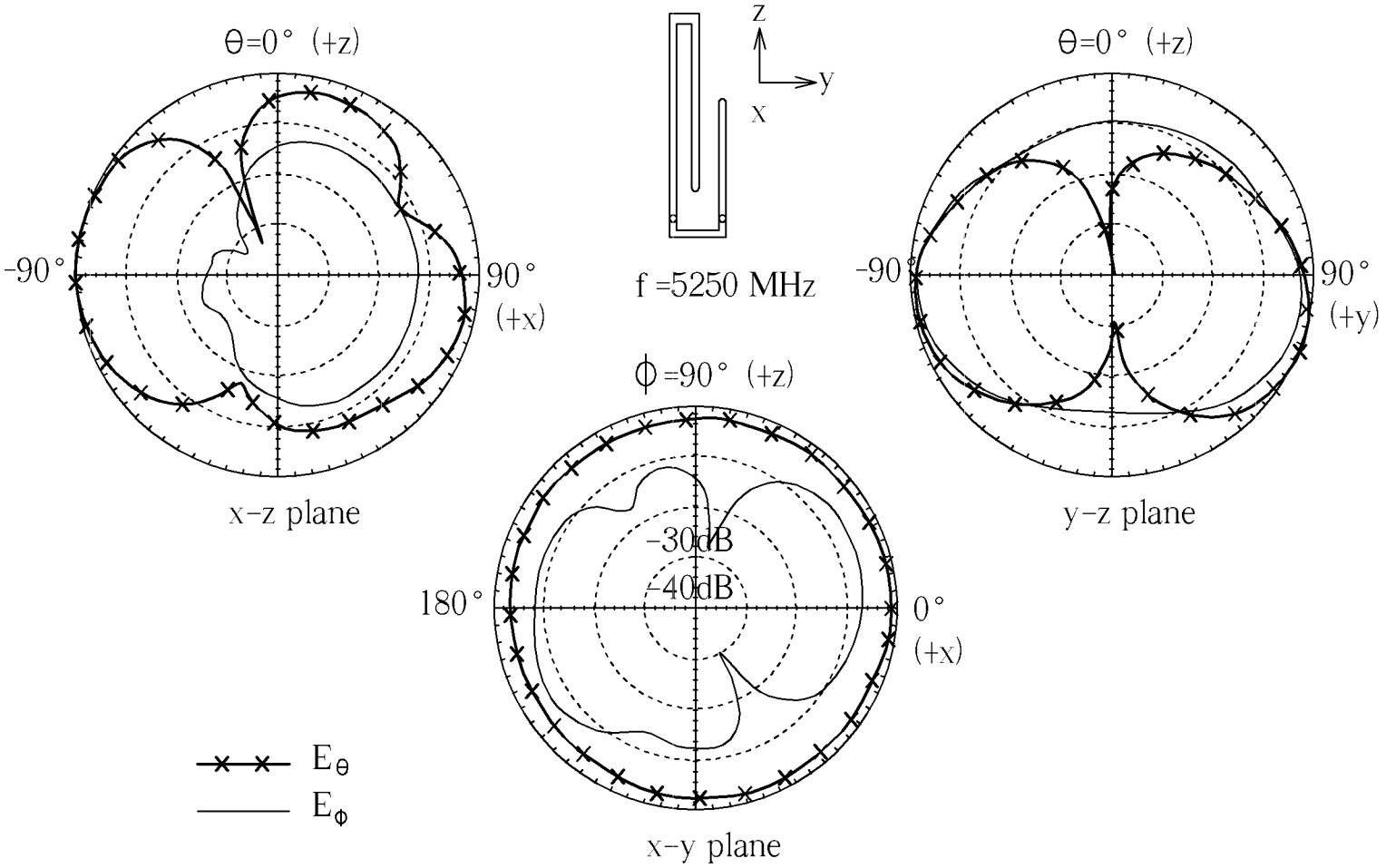
FIG. 10 is a measured schematic diagram of radiation patterns at 5.2 GHz according to the second embodiment of the present invention.

Please refer to FIG. 9 and FIG. 10. FIG. 9 and FIG. 10 is measured schematic diagrams of radiation patterns at 2442 MHz according to the second embodiment of the present invention. FIG. 10 is measured schematic diagrams of radiation patterns at 5250 MHz according to the second embodiment of the present invention. The radiation pattern in the horizontal plane (x-y plane) is omnidirectional radiation patterns, which meets application requirement of WLAN operation.

Figure 11:
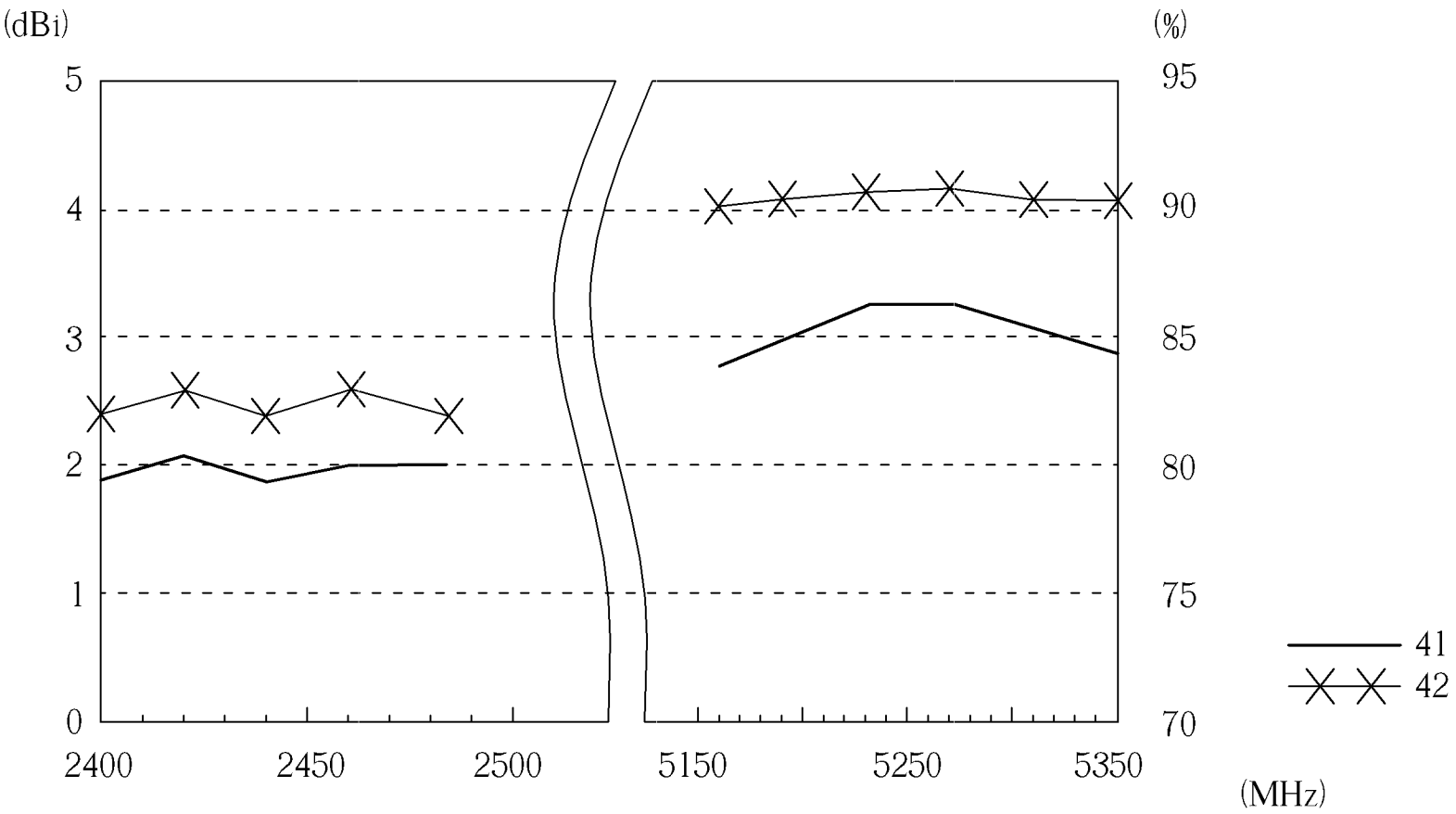
FIG. 11 is a measured schematic diagram of antenna gain and radiation efficiency according to the second embodiment of the present invention.

FIG. 11 is a measured schematic diagram of antenna gain and radiation efficiency according to the second embodiment of the present invention. FIG. 11 shows that antenna gain 41 is about 2 dBi over the 2.4 GHz band, and the radiation efficiency 42 is above 80%. Antenna gain 41 is about 3 dBi within 5.2 GHz band, and the radiation efficiency 42 is above 90%.

In contrast to the prior art, the present invention can solve the disadvantages of large size, high cost, and only for single-band operation of the conventional planar antenna. The wire antenna of the present invention is composed of a multiple-bent single metal wire with compact size, low cost, and simple structure. A wire is bent twice to form the main radiating element, the ground element, and the shorting element so as to reduce the size of the antenna and to operate in the 2.4 GHz band according to the first embodiment according of the present invention. The length of the main radiating element is reduced and the grounding element is bent twice so that the wire antenna is a paper clip structure according to the second embodiment of the present invention. Therefore, the wire antenna is capable of operating in the 2.4 GHz and 5.2 GHz bands for achieving the dual-band antenna operation with well impendence bandwidth.

Those skilled in the art will readily observe that numerous modifications and alterations of the device and method may be made while retaining the teachings of the invention.

What is claimed is:

1. A wire antenna composing of a multiple-bent single metal wire for dual-band operation in a wireless network device, the wire antenna comprising:

a main radiating element comprising a first feed end, a terminal end being opposite to the first feed end, and a first feed point adjacent to the first feed end , for providing a first operating frequency band;

a grounding element, having a total length being a quarter of the wavelength corresponding to a frequency in a second operating frequency band, which is different from the first operating frequency band, so as to provide the second operating frequency band, and the grounding element comprising:

a first element parallel to the main radiating element, the first element comprising a second feed end and a first end, and a second feed point being adjacent to the second feed end;

a second element parallel to the first element and shorter than the first element, the second element comprising a second end; and a third element connected to the first end of the first element and the second ends of the second element; and a shorting element electrically connected to the first feed end of the main radiating element and the second feed end of the first element of the grounding element; and a coaxial cable, comprising a central conducting wire and an outer grounding conductor;

wherein the main radiating element, the first element of the grounding element and the shorting element form a first U-shaped portion, wherein the first element of the grounding element is parallel to and longer than the main radiating element;

wherein the first element, the second element and the third element of the grounding element form a second U-shaped portion, wherein the second element of the grounding element inserts into a space between the main radiating element and the first element of the grounding element;

wherein a length of the main radiating element is smaller than a length of the grounding element;

wherein the first feed point is connected to the central conducting wire of the coaxial cable and the second feed point is connected to the outer grounding conductor of the coaxial cable, whereby a distance between the first feed point, the second feed point and the shorting element can be fine-tuned slightly, so as to obtain well antenna impedance matching over the 2.4/5.2 GHz wireless local area network bands.

2. The wire antenna of claim 1, wherein the grounding element is bent repeatedly so that the wire antenna is a paper clip structure.

3. The wire antenna of claim 1, wherein the characteristic impedance of the coaxial cable is 50Ω for transmitting signals.

4. A wire antenna composing of a multiple-bent single metal wire for dual-band operation in a wireless network device, the wire antenna comprising:

a main radiating element comprising a first feed end, a first terminal end opposite to the first feed end, and a first feed point adjacent to the first feed end, for providing a first operating frequency band;

a grounding element, having a total length being a quarter of the wavelength corresponding to a frequency in a second operating frequency band, which is different from the first operating frequency band, so as to provide the second operating frequency band, the grounding element comprising:

a first element parallel to the main radiating element, the first element comprising a second feed end and a first end, and a second feed point being adjacent to the second feed end;

a second element parallel to the first element and shorter than the first element, the second element comprising a second end; and a third element connected to the first end of the first element and the second ends of the second element; and a shorting element electrically connected to the first feed end of the main radiating element and the second feed end of the first element of the grounding element;

a coaxial cable, comprising a central conducting wire and an outer grounding conductor;

wherein the main radiating element, the first element of the grounding element and the shorting element form a first U-shaped portion, wherein the first element of the grounding element is parallel to and longer than the main radiating element;

wherein the first element, the second element and the third element of the grounding element form a second U-shaped portion, wherein the first element of the grounding element is parallel to and longer than the second element of the grounding element, and the main radiating element inserts into a space between the first element and the second element of the grounding element;

wherein a length of the main radiating element is smaller than a length of the grounding element;

wherein the first feed point is connected to the central conducting wire of the coaxial cable and the second feed point is connected to the outer grounding conductor of the coaxial cable, whereby a distance between the first feed point, the second feed point and the shorting element can be fine-tuned slightly, so as to obtain well antenna impedance matching over the 2.4/5.2 GHz wireless local area network bands.

5. The wire antenna of claim 4, wherein the grounding element is bent repeatedly so that the wire antenna is a paper clip structure.

6. The wire antenna of claim 4, wherein the characteristic impedance of the coaxial cable is 50Ω for transmitting signals.

* * * * *